US007487929B1

(12) United States Patent
Long

(10) Patent No.: US 7,487,929 B1
(45) Date of Patent: Feb. 10, 2009

(54) GRINDING CIRCUIT WITH CYCLONE AND DENSITY SEPARATOR CLASSIFICATION SYSTEM AND METHOD

(76) Inventor: Edward W. Long, 6507 Calais Ct., Dayton, OH (US) 45459

( * ) Notice: Subject to any disclaimer, the term of this patent is extended or adjusted under 35 U.S.C. 154(b) by 0 days.

(21) Appl. No.: 11/862,266

(22) Filed: Sep. 27, 2007

(51) Int. Cl.
*B02C 23/08* (2006.01)

(52) U.S. Cl. ..... 241/79.1; 241/80; 241/81

(58) Field of Classification Search ..... 241/80, 241/81, 79.1
See application file for complete search history.

(56) References Cited

U.S. PATENT DOCUMENTS

| | | | | |
|---|---|---|---|---|
| 4,267,981 A | | 5/1981 | Rowland, Jr. | |
| 4,389,019 A | | 6/1983 | Adrian | |
| 5,104,047 A | * | 4/1992 | Simmons | 241/20 |
| 5,169,073 A | * | 12/1992 | Marabini et al. | 241/20 |
| 5,462,234 A | | 10/1995 | Patzelt et al. | |
| 5,839,673 A | | 11/1998 | Williams | |
| 5,897,063 A | | 4/1999 | Patzelt et al. | |
| 6,613,271 B1 | | 9/2003 | Lewis-Gray | |
| 6,644,572 B1 | * | 11/2003 | Cases | 241/76 |
| 7,111,738 B2 | | 9/2006 | Allen, III | |

FOREIGN PATENT DOCUMENTS

| | | |
|---|---|---|
| GB | 292175 | 6/1927 |
| GB | 547102 | 8/1942 |
| GB | 626861 | 6/1945 |

* cited by examiner

*Primary Examiner*—Faye Francis
(74) *Attorney, Agent, or Firm*—R. William Graham

(57) ABSTRACT

A grinding circuit includes ore and fluid feed lines, a grinding mill connected to the feed lines, a grinding chamber to produce a crushed resultant fluid having ground fines and large particulate therein, a cyclone for receiving crushed resultant fluid having ground fines and large particulate and for expelling at least part of the fluid and the ground fines and dispelling a remainder of the fluid, large particulate and another part of fine grounds gravity flow, a pump to cause the first crushed resultant to flow into the cyclone, a second fluid feed line. A density separator receives the remainder and additional fluid to cause upflow current therethrough such that a part of mixed fluids and the large particulate gravity flow to the grinding mill and at least part of the mixed fluids and another part of the ground fines are circulated back to the cyclone.

3 Claims, 2 Drawing Sheets

GRINDING CIRCUIT WITH CYCLONE AND DENSITY SEPARATOR CLASSIFICATION SYSTEM AND METHOD

FIELD OF INVENTION

This invention relates to a grinding system and method for grinding mineral ores and is adapted for use in a situation in which the grinding apparatus is supplied from a constant feed rate source of ore. More particularly, the invention is directed to a grinding circuit with a cyclone and density separator classification system and method.

PRIOR ART

In a high percentage of mining operations, the ore delivered from the mine to the grinding mill contiguous to the mine varies unpredictably between what has been defined as "satisfactory" ore and what has been defined as "unsatisfactory" ore. "Satisfactory" and "unsatisfactory" ore refer to the geometry, size, and quantity of the pieces of ore in the media size range, or larger than a given size in the ore feed as it is fed to the grinding mill. The mineralogical characteristics of the ore can be and frequently are independent of the autogenous characteristics referred to as "satisfactory" ore and the "unsatisfactory" ore. In grinding mills, the input feed ore is fed satisfactory ore.

Wet grinding is accomplished via slurry of percent solids. Depending on the type of mill employed, size reduction work can be performed different stages of crushing and screening, and separation. Autogenous mills operate without grinding bodies; instead, the coarser part of the ore simply grinds itself and the smaller fractions. Semi-autogenous mills (which have become widespread), 5 to 10 percent grinding bodies (usually metal spheres) are added. In this process stage, the crushed material can be further disintegrated in a cylinder mill, which is a cylindrical container built to varying length-to-diameter ratios, mounted with the axis substantially horizontal, and partially filled with grinding bodies (e.g., flint stones, iron or steel balls) that are caused to tumble, under the influence of gravity.

Hydrocyclones have been employed in the art to promote the separation of heavy and light components. The hydrocyclone converts incoming liquid velocity into rotary motion whereby heavy components move outward toward the wall of a cylinder where they agglomerate and spiral down the wall to the outlet at the bottom of the vessel and light components move toward the axis of the hydrocyclone where they move up toward the outlet at the top of the vessel. This type of known system is illustrated in FIG. 1 which depicts a grinding mill in use with a cyclone and fluid feed unit for gold ore.

A focus of existing systems is to reduce power consumption and maximize efficiency of the grinding system. It is desirable to provide a system which maximizes the output flow grinding mill with less input power per ton of the ore being ground. It is also desirable to improve a grinding mill's capacity and maintain high solids ratio.

SUMMARY OF THE INVENTION

It is therefore an object to provide an improved grinding circuit.

It is a further object of the invention to provide an improved system and method for grinding mineral ores through the use of a cyclone and a density separator for classification.

It is a further object to maintain high solids content in a wet grinding mill system.

Yet another object is to prevent over-grinding of ore by removing fines from circulating load.

A further object is to increase capacity of a grinding mill with addition of new feed to replace over-ground fines.

Still another object is to reduce power consumption.

Another object is to reduce circulating-load in a grinding circuit.

Accordingly, the present invention is directed to a grinding circuit with a cyclone and density separator classification system and method. The grinding system with multiple classifications for grinding mineral ore includes an ore feed line;

a first fluid feed line;

a grinding mill having an inlet operably connected to the ore feed line and the first fluid feed line to receive ore and fluid, a grinding chamber for grinding the ore and fluid in a manner to produce a first crushed resultant fluid having ground fines and large particulate therein, and having an outlet through which the resultant fluid exits;

a cyclone having an inlet and a first top outlet for expelling at least part of the ground fines and fluid and a second bottom outlet through which a remainder fluid, the large particulate and another part of the fine grounds gravity flow;

a pump operably receiving the resultant fluid from the outlet of the grinding mill to cause the first crushed resultant to flow into the inlet of the cyclone;

a second fluid feed line; and a density separator having a first upper inlet in communication with the second bottom outlet of the cyclone to receive the remainder of the fluid, the large particulate and the another part of the fine grounds, a second lower inlet operably connected to the second fluid line to receive fluid providing mixed fluids, the large particulate and another part of the fine grounds and to cause upflow current therethrough, a first bottom outlet through which a part of the mixed fluids and the large particulate gravity flow to the grinding mill, and a second upper outlet in communication with the resultant fluid exiting the outlet of the grinding mill and through which at least part of the mixed fluids and another part of the ground fines flow thereto.

The system is adapted for use where ore is required to be fed for grinding from a supply source at a rate which is a function of the ore characteristics. In this regard, the fluid feed rates are configured as a function of the fluid, large particle and fines flow rate.

A method of for grinding ore with multiple classifications includes the steps of:

introducing ore and a first fluid into a grinding mill wherein a grinding chamber grinds ore and fluid in a manner to produce a first crushed resultant fluid having ground fines and large particulate therein;

introducing said first crushed resultant fluid having ground fines and large particulate into a cyclone wherein at least part of the ground fines and fluid are expelled out of a first top outlet and wherein a remainder fluid, the large particulate and another part of the fine grounds gravity flow through a second bottom outlet; and introducing said remainder fluid, the large particulate and another part of the fine grounds and a second fluid into a density separator to form a mixture therein and to cause upflow current therethrough such that a part of the mixed fluids and the large particulate gravity flow from the density separator to the grinding mill and at least part of the mixed fluid and another part of the ground fines flow to the back to the cyclone.

Further objects and advantages of the invention will become apparent from the following description taken in conjunction with the accompanying drawings in which:

DESCRIPTION OF THE PREFERRED EMBODIMENT

Figure 1:
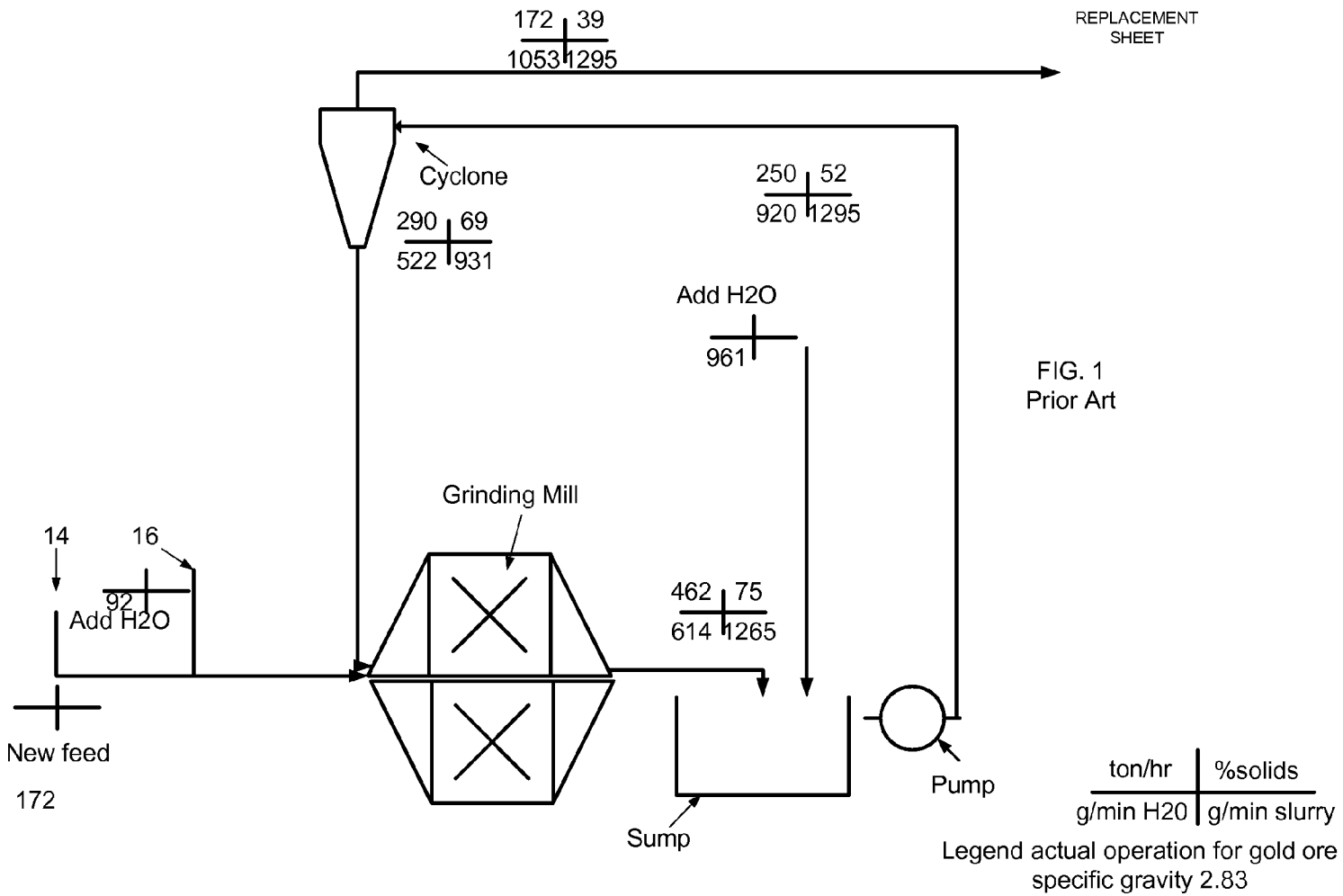
FIG. 1 Prior Art
FIG. 1 is a schematic of a prior grinding system employing known classification system.

Referring now to the drawings, there is shown a grinding circuit in accordance with the invention comprising which is generally designated by the numeral 10. The grinding circuit 10 includes grinding mill 12 which is equipped with drive components known to the art and can be of any type known in the art, such as a partially or fully autogenous grinding mill.

The grinding mill 12 is operably connected to an ore feed line 14 and a first fluid (water) feed line 16. The ore feed line 14 supply from an ore supply which may be mill feed bins or other suitable mill feed storage means. A feeder known in the art can be provided driven by variable speed d.c. electric motors, for example, which dispense the ore onto conveyor feed belt which delivers the ore into grinding mill 12. It is noted that there exist many means to feed a grinding mill and the invention is not limited in this regard.

The grinding mill 12 has an inlet 18 operably connected to the ore feed line 14 and the water feed line 16 to receive ore and water and a grinding chamber 20 for grinding the ore and water in a manner to produce a first crushed resultant water having ground fines and large particulate 22 therein, and has an outlet 24 which leads to a sump 26.

A cyclone 28 is provided and has an inlet 30 and a first top outlet 32 for expelling at least part of the ground fines and water and a second bottom outlet 34 through which a remainder water, the large particulate and another part of the fine grounds gravity flow. A pump 36 operably interconnects to the outlet 24 via sump 26 with the inlet 30 of the cyclone 28 to cause the first crushed resultant 22 to flow into the cyclone 28.

A second fluid (water) feed line 38 is provided which feeds a density separator 40. The density separator 40 has a first upper inlet 42 in communication with the second bottom outlet 34 of the cyclone 28 to receive the remainder of the water, the large particulate and the another part of the fine grounds. A second lower inlet 44 operably connects to the second fluid line 38 to receive water providing mixed water, the large particulate and another part of the fine grounds and to cause upflow current therethrough. A first bottom outlet 46 is provided through which a part of the mixed water and the large particulate gravity flow, and a second upper outlet 48 is provided in communication with the sump 26 and through which at least part of the mixed fluids and another part of the ground fines flow thereto.

It should be noted that both of the grinding mill 12 is assumed to be operating in accordance with the wet grinding method in accordance with which the ore being ground in the mill is in the form of water slurry. Water necessary to form the slurry is added to each of the respective grinding mills through an inlet indicated at 18 in connection with mill 12.

When the system is in operation, the ore is delivered to the mill 12 at preferably a constant speed. It is contemplated that the speed of feed to deliver ore is at a variable feed rate as the application requires to compensate for variations in the grinding characteristics of the ore and to maintain a constant input horsepower to the grinding mill 12. The delivery of ore can be controlled in such manner that the rate of ore delivery to grinding mill 12 which is compatible with input horsepower.

The grinding mill 12 is connected in a closed grinding circuit and the grinding circuit. Thus, the ground resultant 22 is discharged from outlet 24 and into cyclone 30. The oversize or large particulate flows through to the density separator 40 and fine particular (fines) flow out the top outlet 32 for further processing. The water, the large particulate and another part of the fine grounds and additional water are commingled in density separator 40 to form a mixture therein and the additional water flow causes upflow current therethrough such that a part of the mixed fluids and the large particulate gravity flow from the density separator 40 back to inlet 18 of the grinding mill 12. At least part of the mixed fluid and another part of the ground fines flow from the outlet 48 back to the cyclone 30 via sump 26 and pump 36. All of the ore returned to the mill 12 for further grinding is called circulation load. The undersize material or fines are discharged by either cyclone 30 or density separator 40 (the classifiers).

It is contemplated that alternative other screening filters might be employed in combination with the invention to perform filtering of fines. For example, a screen might be employed to determine ore of acceptable size and subsequent processing of fines.

Figure 2:
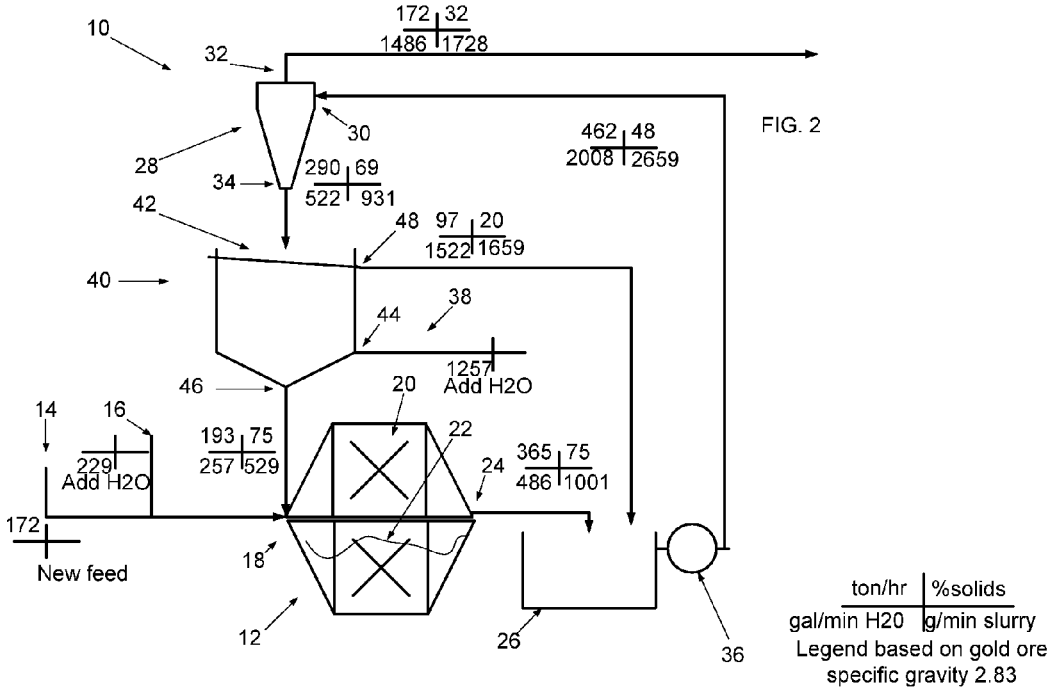
FIG. 2 is a schematic of an arrangement of a grinding mill employing a classification system of the instant invention.

In accordance with the invention, an example of the control system is provided to control the operation of grinding circuit 10. The grinding circuit can operate at a constant power draw with a variable rate of feed of the ore to the grinding mill 12. Since the grinding characteristics of the ore fed through grinding mill 12 may be constantly varying, requiring varying power inputs to the grinding mill 12 for a given weight of ore depending on the varying grinding characteristics of the ore, means known to the art can be provided to vary the feed rate of the ore to grinding mill 12 to maintain the power input to mill 12 substantially at a predetermined constant value. By way of example, the FIG. 2 illustrates the potential gain in flow rate ton per hour (TPH) of feed output as compared to that of the prior art in FIG. 1 for gold ore. This makes room for new feed.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

What is claimed is:

1. A grinding circuit for grinding mineral ore, which comprises:

an ore feed line;

a first liquid fluid feed line;

a grinding mill having an inlet operably connected to said ore feed line and said first liquid fluid feed line to receive ore and fluid, a grinding chamber for grinding said ore and liquid fluid in a manner to produce a first crushed resultant fluid having ground fines and large particulate therein, and having an outlet through which said first crushed resultant fluid having ground fines and large particulate exit;

a cyclone having an inlet for receiving said first crushed resultant fluid having ground fines and large particulate, a first top outlet for expelling at least part of said fluid and said ground fines and a second bottom outlet through which a remainder of said fluid, said large particulate and another part of said fine grounds gravity flow;

a pump operably receiving said first crushed resultant fluid having ground fines and large particulate exiting from said outlet of said grinding mill to cause said first crushed resultant to flow into said inlet of said cyclone;

a second liquid fluid feed line; and a liquid density separator having a first upper inlet in communication with said second bottom outlet of said cyclone to receive said remainder of said fluid, said large particulate and said another part of said fine grounds, a second lower inlet operably connected to said second liquid fluid line to receive liquid fluid providing mixed fluids, said large particulate and another part of said fine grounds and to cause upflow current therethrough and provide controlled commingled particulate mixture of the ground fines and large particulate, a first bottom outlet through which a part of said mixed fluids and said large particulate gravity flow to said grinding mill, and a second upper outlet in communication with the resultant fluid exiting the outlet of the grinding mill and through which at least part of said mixed fluids and another part of said ground fines flow thereto.

2. The grinding circuit of claim 1, wherein said liquid fluids include water.

3. The grinding circuit of claim 1, which includes a sump operably disposed between and in communication with said outlet of said grinding mill and said pump to receive said resultant fluid from said grinding mill and said part of said mixed fluids and another part of said ground fines from said liquid density separator.

* * * * *